United States Patent [19]

Chatard et al.

[11] 3,941,146

[45] Mar. 2, 1976

[54] APPARATUS FOR STORING A FLEXIBLE ELONGATED MEMBER, SUCH AS A FLEXIBLE DRILL COLUMN

[75] Inventors: Michel Chatard, Chatou; Pierre Grolet, Orgerus; Remi Reynard, Montesson; Jean Thiery, Le Pecq, all of France

[73] Assignee: Institut Francaise du Petrole, des Carburants et Lubrifiants, France

[22] Filed: Feb. 20, 1974

[21] Appl. No.: 444,189

Related U.S. Application Data

[63] Continuation-in-part of Ser. No. 264,470, June 20, 1972, Pat. No. 3,804,111.

[30] Foreign Application Priority Data

June 29, 1971 France ..... 71.23842

[52] U.S. Cl...... 137/355.16; 175/103; 242/54 R; 242/83; 52/65; 137/355; 137/28

[51] Int. Cl.[2]..... B65H 15/36

[58] Field of Search..... 137/355.16, 355.28; 61/72.3; 166/77; 175/103; 242/54, 83

[56] References Cited

UNITED STATES PATENTS

| | | | |
|---|---|---|---|
| 2,262,900 | 11/1941 | Morgan | 242/83 |
| 2,764,783 | 10/1956 | Teller | 52/65 |
| 2,846,962 | 8/1958 | Morgan | 52/65 |
| 2,929,577 | 3/1960 | Henning | 242/83 |
| 2,959,279 | 11/1960 | Krafft et al. | 242/83 X |
| 2,964,144 | 12/1960 | Wheeler | 52/65 |
| 3,247,674 | 4/1966 | Macardier | 242/54 R |
| 3,491,496 | 1/1970 | Johnston | 52/65 |
| 3,559,905 | 2/1971 | Palynchuk | 242/54 R |
| 3,667,554 | 6/1972 | Smitherman | 166/77 |
| 3,804,111 | 4/1974 | Chatard et al. | 137/355.16 |

*Primary Examiner*—Henry T. Klinksiek
*Attorney, Agent, or Firm*—Craig & Antonelli

[57] ABSTRACT

The present invention relates to an apparatus or device for storing elongated flexible elements, such as drilling pipe, in a coiled form. This apparatus includes an inner cylindrical framework supported about a vertical axis, an outer cylindrical framework concentrically separated from the inner framework and connected thereto by an annular base plate closing the bottom of the apparatus. The space between the inner and outer frameworks is open at the top to receive the elongated elements, and the annular base plate is formed of a plurality of annular sector elements connected together in such a manner as to allow a vertical displacement of respective adjacent elements with respect to one another. Various means for connecting adjacent elements are provided. Moreover, various driving and supporting members are provided for rotating the apparatus about the vertical axis.

25 Claims, 10 Drawing Figures

APPARATUS FOR STORING A FLEXIBLE ELONGATED MEMBER, SUCH AS A FLEXIBLE DRILL COLUMN

This application is a continuation-in-part application of previous U.S. application, Ser. No. 264,470 filed June 20, 1972, now U.S. Pat. No. 3,804,111, and incorporates herein all the disclosure of said previous application.

The present invention relates to an apparatus for storing an elongated flexible element, such as a cable or flexible hose, pipe, or columns.

More particularly, and not to be construed as limitative, the apparatus according to the present invention is adapted for storing and for handling a flexible drilling column.

Apparatus and devices for storing flexible drilling columns are known. These apparatus generally consist of an annular basket which is supported on a vertical pin or axle placed coaxial with the basket. Driving means drive the basket in rotation about the vertical axle and are integral with a base structure on which rests the entire apparatus.

A rotating hydraulic connector placed in the axis of the basket allows for supplying the flexible column with hydraulic fluid.

The principal drawbacks of these previous apparatus consist in the construction thereof which requires the use of a completely rigid base structure for the entire unit or the entire apparatus and makes it necessary to maintain a very good verticality of the vertical axis and of the axis of the basket in order to avoid that, due to the action of the great weight of the flexible column or pipe, the swivel be subjected to abnormal stresses, for example, due to the action of unbalances during the rotation of the basket. It is apparent, therefore, that the apparatus made in this manner are cumbersome, difficult to use and manage, and require a significant amount of maintenance and supervision.

It is the object of the present invention to provide for an apparatus for storing an elongated element which does not have the drawbacks of the prior art devices as outline above.

The present invention will be better understood, and its advantages will become more apparent, from a reading of the following description of the present apparatus with the several embodiments thereof, being non-limitative and illustrated in the accompanying drawings, wherein FIG. 1 illustrates schematically a first embodiment of the apparatus proposed by the present invention;

In these figures, the same reference numerals have been used to identify like elements.

FIG. 1 illustrates schematically a first mode of realization or embodiment of the appartus according to the present invention designed for storing an elongated flexible element, such as a flexible drilling pipe or columns 18.

Figure 1:
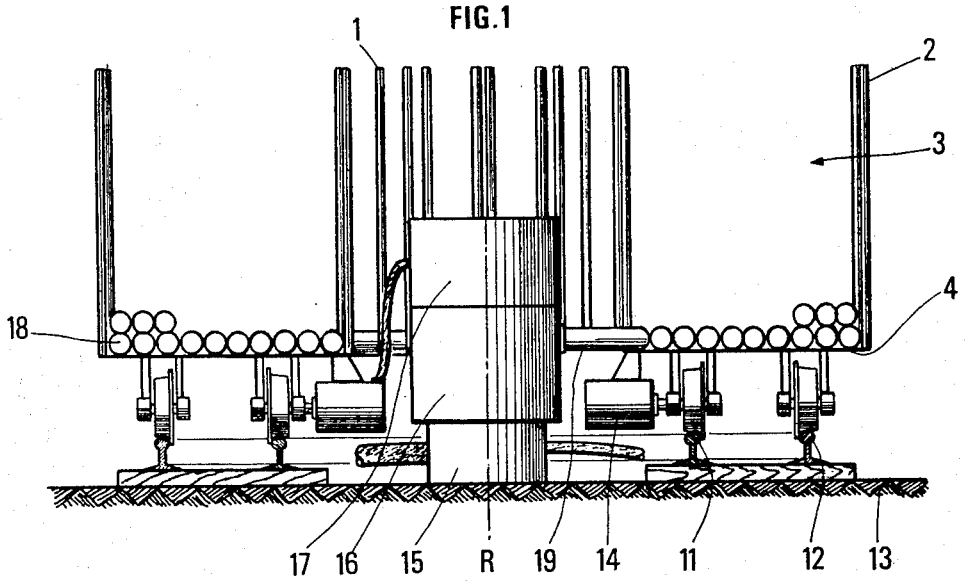

The present apparatus includes an inner cylindrical frame 1 disposed vertically and an outer cylindrical frame 2 placed concentrically with respect to the frame 1. The distance in the radial direction separating the two frames is greater than the diameter of the cross section of the flexible pipe or column 18, and the radius of the inner frame 1 from a central axis of the frame is at least equal to the minimum radius of curvature of the flexible column stored in the apparatus. The two frames form therebetween in the radial separation a space 3 which is closed at the lower part by an annular base structure or plate 4, and open at the upper part thereof so as to allow for the passage of the flexible column 18.

Figure 2:
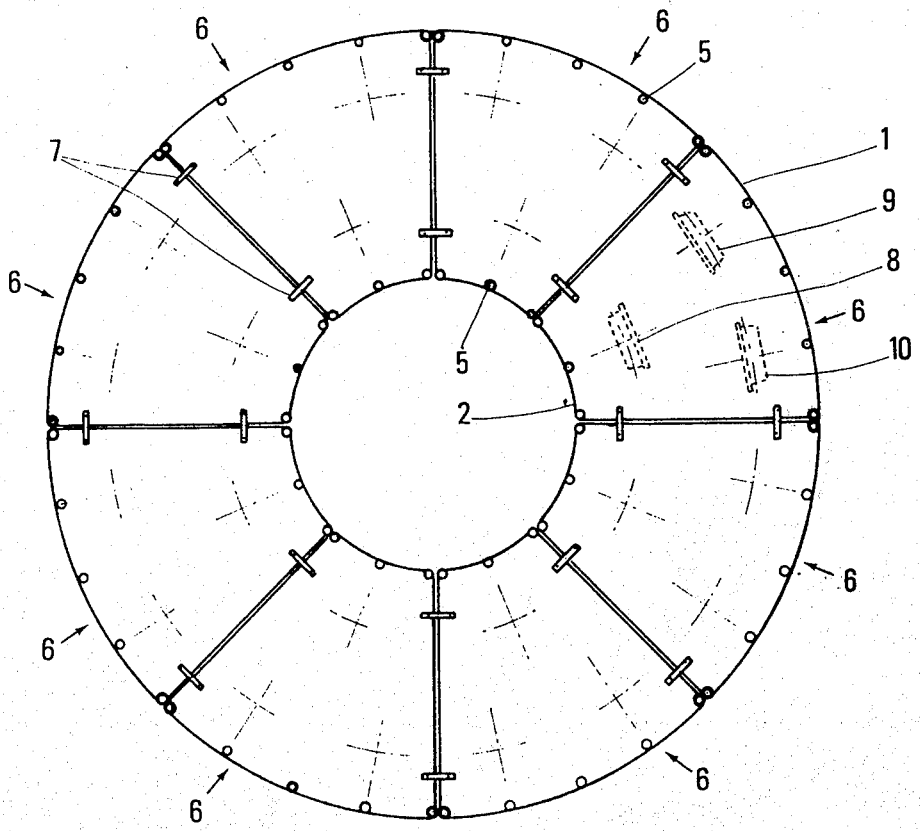
FIG. 2 is a view from below of the apparatus illustrated in FIG. 1.

The frames 1 and 2 may consist of rigid vertical bars 5 spaced annularly about the annular base 4, as schematically represented in FIGS. 1 and 2.

The base structure 4 consists of a plurality of elements 6, each having essentially the form of an annular sector and each supporting a corresponding portion of the cylindrical frames 1 and 2. The elements 6 are interconnected by connecting members indicated schematically at 7, so as to form the annular base plate 4. For reasons which will be explained further hereinbelow, these connecting members or means allow for a slight relative movement of the elements 6 with respect to each other in at least one direction having a vertical component.

Secured under each element 6 in a manner known per se are three wheels 8, 9 and 10 (FIG. 2), but this number is not limitative. These wheels which support the base structure 4 are adapted to be displaced on a guide path consisting, for example, of two concentric rails 11 and 12 being substantially centered on the axis of the apparatus. These rails rest on a ballast 13 provided for this purpose. The wheels 8, 9, 10 and the rails 11, 12 constitute means for guiding the apparatus in rotation and cooperate so as to assure, on the one hand, the centering of the base structure 4 on the vertical axis of rotation and to support, on the other hand, the total weight of the annular basket and its contents.

As is apparent from FIGS. 1 and 2, the guide rails 11, 12 and the wheels 8, 9 and 10 are spaced from the vertical axis of rotation R of the apparatus and are preferably disposed below the annular base plate. The guide rails 11 and 12 are spaced at a distance from the axis of rotation R at least equal to the radius of the inner frame, so that the central portion between the axis of rotation R and the inner frame 1 is open.

Some of the wheels are integral with the outlet shafts of motors 14 for driving the apparatus in rotation about the vertical axis thereof. The motors 14 may be either hydraulic or electric motors.

In this manner, the rotary drive means constituted by the driving wheels are also spaced or removed from the axis of rotation and leave open the central portion of the annular basket.

If the elongated element 18 to be stored in the apparatus is a pipe which must be supplied with hydraulic fluid, such as flexible drilling column, one places in the central portion of the annular basket a rotary hydraulic connector or coupler 16 of any known type which is disposed on a stationary axis 15 extending essentially along the vertical axis of rotation R. The rotating part of this connector is driven by the apparatus and assures the supply of hydraulic fluid to the flexible column 18 by means of a pipe or duct 19.

A second rotating connector 17 allows for supplying the drive motors 14 with power. This connector may be a hydraulic connector similar to the connector 16 in the case where the motors 14 are hydraulic motors, or it may be an electric connector in the case where the motors are electric motors.

Such an apparatus affords the advantage that it is easily used or operated. In comparison to the previously known devices, it does not require a complelety rigid and nondeformable supporting structure. As a matter of fact, the faults of unevenness of the ballast will become manifest as a slight relative movement of the elements 6 with respect to each other, which movement of the elements cooperates with the flexible pipe 18.

Figure 3:
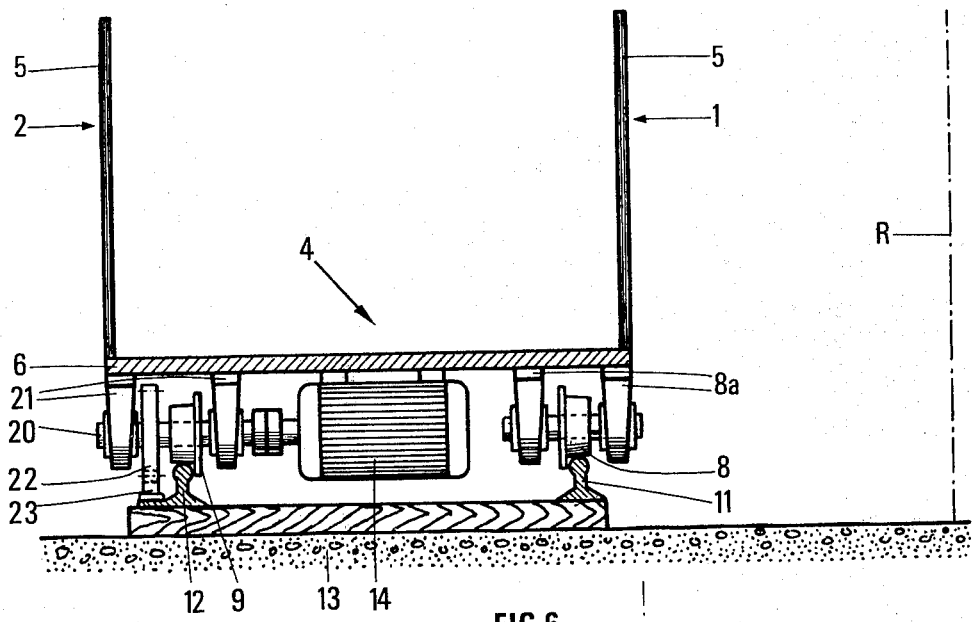
FIG. 3 illustrates a modified embodiment of the apparatus represented in FIG. 1.

FIG. 3 represents a modified embodiment of that shown in FIGS. 1 and 2. As apparent in FIG. 3, in a vertical cross-sectional view, an element 6 makes up the annular base plate or platform 4.

In certain cases, for example in order to obtain a correct arrangement of the coils formed by the elongated flexible pipe in the apparatus, one is led to control the speed or the angle of rotation of the base plate 4, for example, as function of the length of the elongated flexible pipe which is coiled in the space delimited between the frames 1 and 2.

However, slippage of the drive wheels (FIGS. 1 and 2) on the guide rail, which may possibly be produced at the time of an acceleration or of a deceleration of the speed of rotation, prevents one from controlling the speed of rotation of the storing basket with sufficient precision.

In order to control the speed of rotation of the base plate or platform more effectively, it is preferred, according to the modified embodiment represented in FIG. 3, to use distinct drive means comprising at least one motor whose oulet shaft is integral in rotation with a toothed pinion, which engages an annular toothed rack. These drive means are preferably spaced from the axis of rotation of the storing basket so as to leave open the central portion between the axis of rotation and the inner frame of the storing basket.

In the embodiment illustrated in FIG. 3, the motor 14 is secured under an element 6 of the base plate or platform 4. The outlet shaft 20 of the motor, supported by bearings 21, is integral with a toothed pinion 22 which engages an annular toothed rack 23 held stationary and placed concentrically to the guide rail 12. The annular toothed rack 23 may be welded, for example, onto said guide rail 12.

In order not to make the storing basket excessively heavy, the shaft 20 is used also for carrying a guiding wheel, such as 9. This wheel rotates freely about the axis of the shaft 20, but it will not constitute a departure from the spirit and scope of the present invention to provide the wheel 9 and the drive shaft 20 so as to be integral in rotation.

Moreover, it is equally possible to secure the toothed rack 23 under the annular base plate or plateform 4, and the motor 14 driving the toothed pinion 22 is then integral with the ballast 13.

In all of the embodiments of the present invention, the total weight of the storing basket is permanently supported only by the guide means consisting of the wheels 8, 9 and the guide rails 11, 12.

Figure 4:
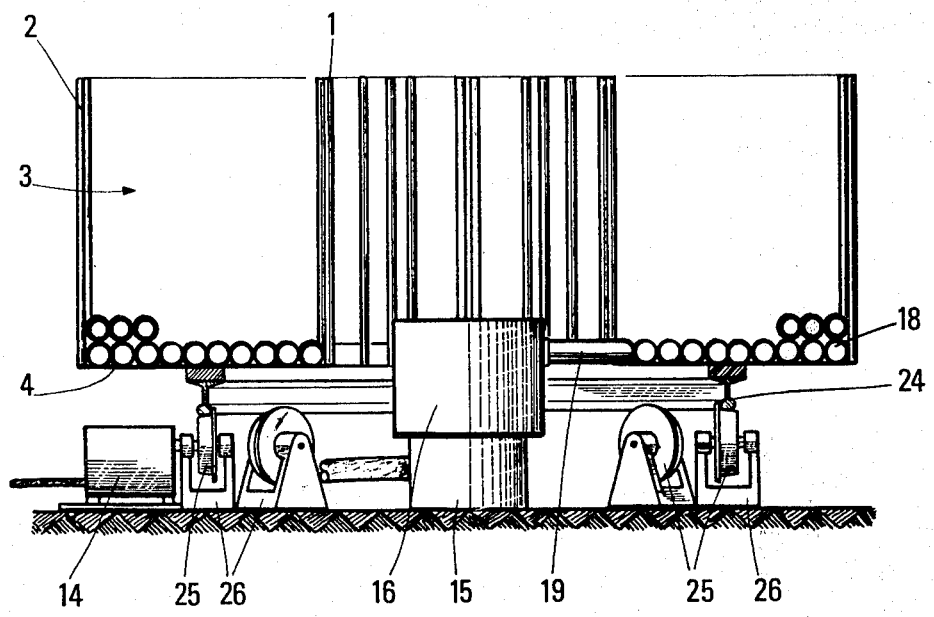
FIG. 4 illustrates a further embodiment of the present invention.

FIG. 4 represents another embodiment of the apparatus according to the present invention. In this embodiment, the guide path is provided by a rail 24 which is integral with the annular base plate or platform 4. This rail rests on a plurality of wheels or rollers 25 disposed on frames or stands 26 resting on the ballast 13.

Hydraulic or electric motors 14 actuate certain of the wheels 25 so as to bring about the rotation of the storing apparatus about the vertical axis thereof.

This arrangement affords the advantage that no rotating connector is required for feeding the motors 14 with power.

Figure 5:
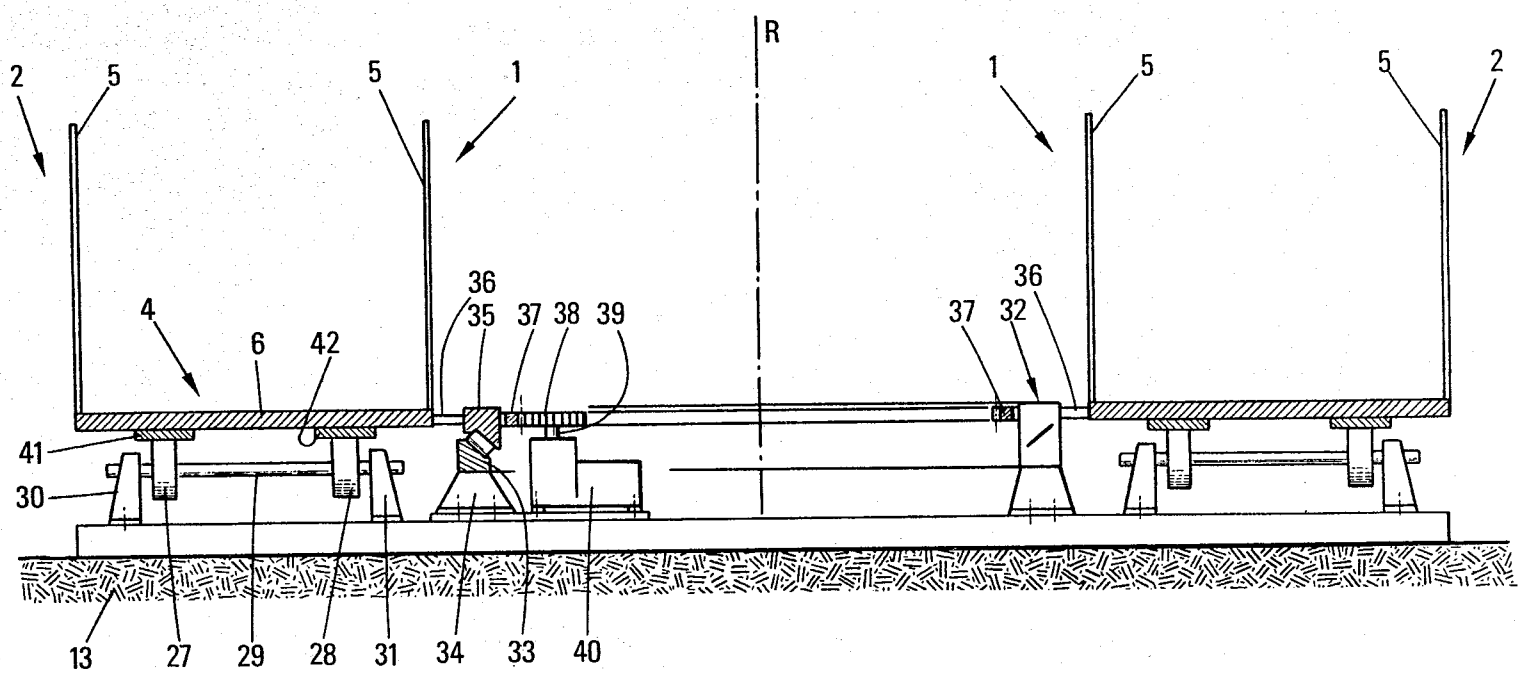
FIG.5 illustrates a still further embodiment of the present invention.

FIG. 5 illustrates yet another embodiment of the apparatus according to the present invention.

In this embodiment, annular bearing belts 41 and 42 are secured under the annular base plate or platform composed of the elements 6. These bearing belts have an annular shape centered on the axis of rotation of the apparatus. Each of the bearing belts is in contact with a plurality of wheels 27, 28 disposed on axles, such as the axle 29, supported by bearings 30, 31 resting on the ballast 13.

The wheels are, for example, rotatably mounted on the axles 29 and each have a width smaller than that of the roller belts 41, 42 so that contact between the wheels 27, 28 and the roller belts 41, 42 is maintained at all times despite any off-positioning of the base plate or platform 4 which could occur during the rotation of the latter.

The bearing belts and the wheels are in operative engagement so as to support the total weight of the apparatus and the contents thereof.

The centering of the base plate or platform 4 is assured by a roller bearing 32 centered about the axis of rotation of the apparatus and having, for example, a conical or tapered roller belt.

One of the rings composing or making up this roller or bearing, for example the ring 33, is stationary. This ring is disposed on a support 34 resting on the ballast 13. The ring 35 constituting a second ring of the roller bearing 32 is integral in rotation with the annular base plate or platform 4. As is apparent from this figure, this integral provision is obtained by arms 36 which hold the ring 35 concentrically with respect to the vertical axis of rotation of the apparatus.

Secured onto the ring 35 is a toothed crown or rim 37 which is in operative engagement with a toothed wheel 38 integral with the outlet shaft 39 of a geared motor group 40 secured to the ballast 13.

The operation of the device is easy to understand: The motor of the geared motor group 40 is supplied with power and drives in rotation the toothed wheel 38. The latter in turn communicates the rotating movement to the crown 37 which, by means of the ring 35 and the connecting arms 36, drives the base plate or platform 4 in rotation.

In the embodiment decribed above, the guide means comprise, on the one hand, the bearing belts 41, 42 and the wheels 27, 28 with the engagement of the wheels 27, 28 with the roller bands 41, 42 supporting the entire weight of the apparatus and the contents thereof and, on the other hand, the bearing 32 assuring the centering of the base plate of platform 4 about the axis of rotation of the apparatus. The drive means consist of the toothed crown 37 which is in operative engagement with the toothed wheel 38 driven in rotation by the geared motor 40.

It is apparent from FIG. 5 that the guide means and the drive means are spaced or removed from the axis of rotation so as to free the central part of the apparatus.

In order to compensate for the faults of unevenness of the ballast and in order to assure that the bearing 32 will operate under normal operating conditions, elastic means (not shown) are provided for maintaining the ring 33 in contact with the roller bearings 32. These elastic means may consist of springs, or of hydraulic jacks, supplied at constant pressure and interposed between the ring 33, or its support 34, and the ballast.

Analogously, elastic means (not shown) may keep the toothed wheel 38 in gear with the toothed crown 37.

Figure 6:
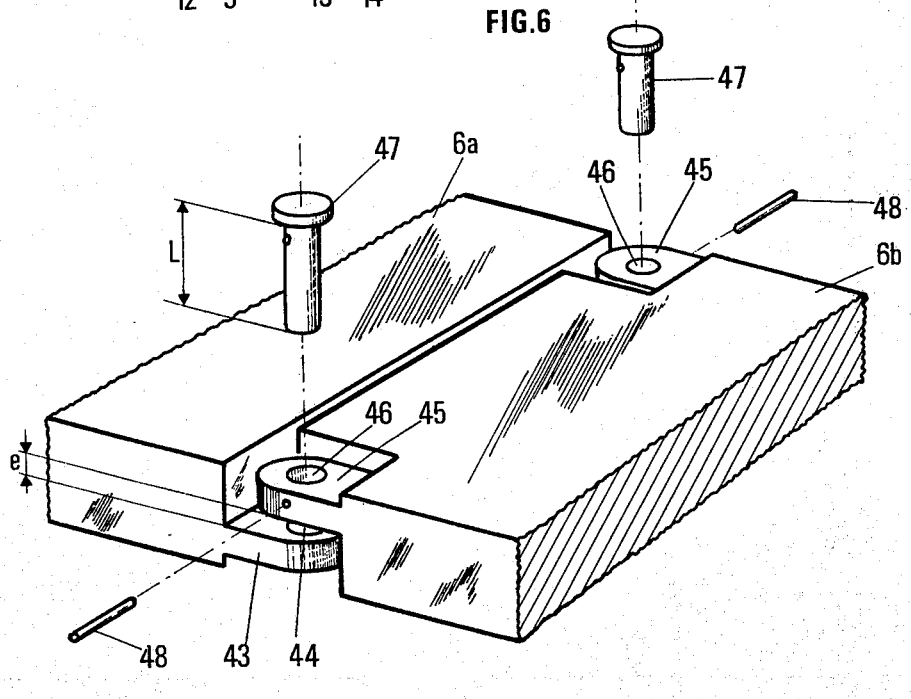
FIGS. 6, 7, 7A, 8A and 8B illustrate schematically different embodiments of the members assuring the connection between the annular sector elements constituting the annular base structure or plate.

FIG. 6 represents a first embodiment of a means connecting two consecutive annular sectors, such as 6*a*, 6*b*, making up the base plate or platform 4.

Secured to the ends of the sector element 6*a*, for example by welding, are connecting clamps 43 into which vertical orifices 44 are drilled. Analogously, additional connecting clamps 45 are welded to the ends of the sector element 6*b*, these connecting clamps being provided with vertical orifices 46.

The two pairs of connecting clamps 43, 45 are secured at different levels of the elements 6*a*, 6*b* so that, by bringing together the elements 6*a* and 6*b*, the clamps of one of these elements become superimposed to the connecting clamps of the other element, thereby bringing the orifices 44 and 46 into alignment. A vertical space *e* is provided between the superimposed clamps to allow for a relative displacement of the elements 6*a* and 6*b*, thus compensating for the unevenness of the ballast. This displacement is effected, therefore, in a vertical direction.

The connection of the elements is accomplished by means of cylindrical centering rods 47 which are accommodated in the orifices 44 and 46. These rods 47 may be made integral with one of the connecting clamps, for example by means of a pin 48. The length L of the rods 47 is chosen to be sufficient to allow for the vertical displacement of the elements 6*a* and 6*b*.

Toward this same end, it is possible to give to the spacing *e* between two superimposed connecting clamps, a value greater than the amplitude of the vertical displacements of the element 6*a*.

Figure 7:
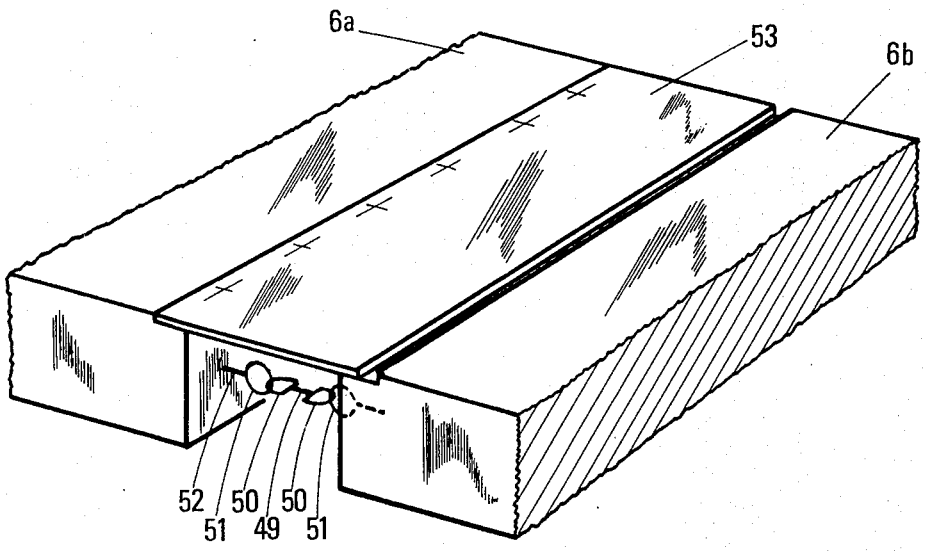

FIG. 7 represents another embodiment of the connecting means between two consecutive sector elements 6*a*, 6*b* which form the annular base plate or platform 4.

These connecting means consist of one or more small rods 49 whose ends are extended by rings 50, which are interlaced or intertwined with rings 51 equipped with rods 52 secured, for example by means of screw nuts, to the ends of the elements 6*a* and 6*b*.

Figure 7A:
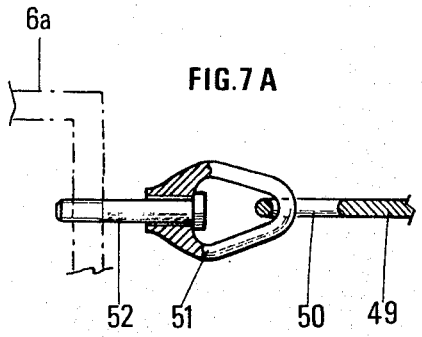

The rod 52 may also be directly screwed on to the corresponding element 6*a* in the case where the ring 51 may rotate about the threaded rod 52, as shown in FIG. 7A.

In this manner, the small rods 49 are hingedly disposed at the ends of the elements 6*a* and allow for displacements of these elements with respect to one another along at least one direction having a vertical component, so as to compensate for the defects of unevenness of the ballast.

As is apparent from FIG. 7, the continuity of the base plate or platform may be assured by a protective plate 53 secured on an element 6*a*, one end of which rests on the element 6*b* in a manner such as to cover the spacing between the two consecutive elements 6*a* and 6*b*.

Figure 8A:
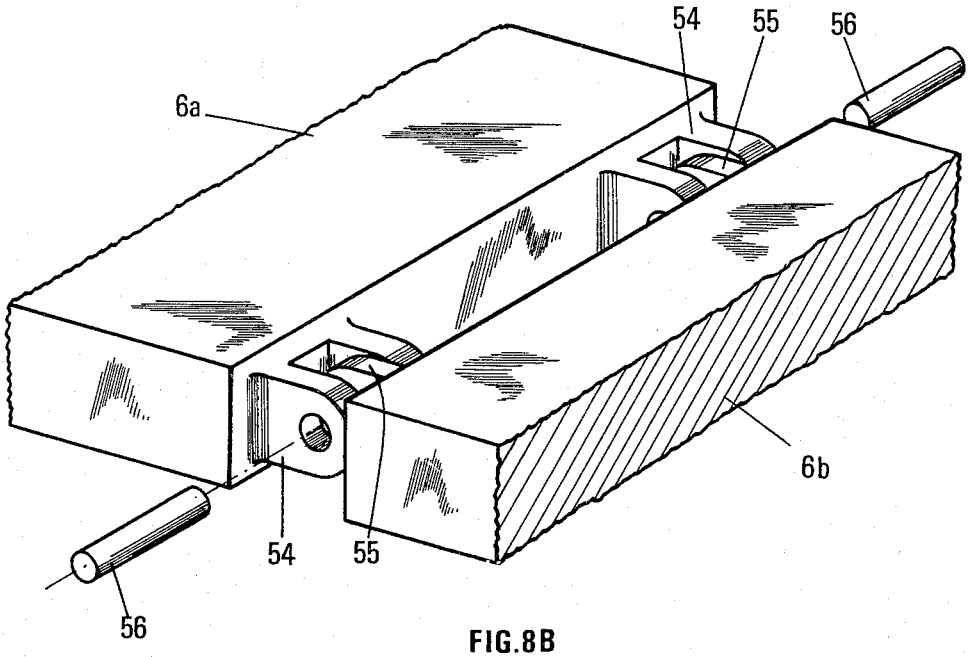

Another type of connecting means is illustrated in FIG. 8A. The end of an element 6*a* is equipped with at least one double flange member 54, which includes a channel between the planer flanges of the double flange member. The end of the adjacent element 6*b* is extended by at least one plate 55 which, in a coupling of the elements 6*a* and 6*b*, will be positioned within the channel between the side flanges of the double flanged member 54. The connection between the elements 6*a* and 6*b* is assured by an axle 56 disposed horizontally and extending through an aperture in each of the flanges of the double flange member 54 and an aperture in the plate 55, so that rotation is provided about the axle 56.

Figure 8B:
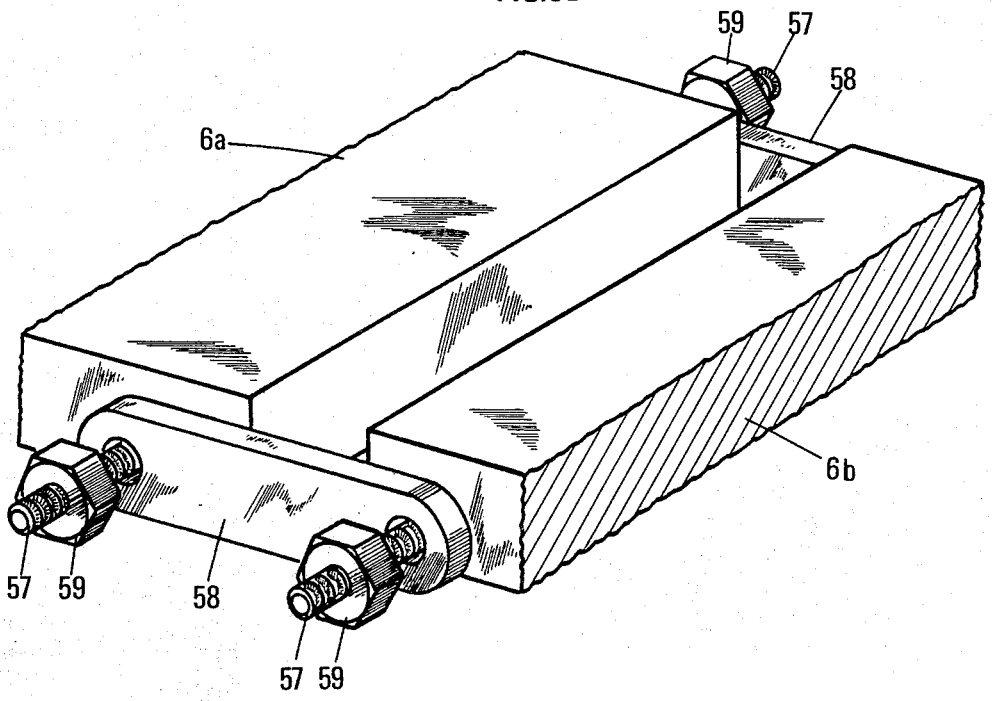

Another modified embodiment of the connecting means is shown in FIG. 8B. Each element 6*a*, 6*b* is provided at the end thereof with horizontal axles 57. The connection between the elements 6*a* and 6*b* is assured by small plates 58 equipped with two orifices in which engage the horizontal axles 57. Screw nuts 59, or spring or snap rings maintain the small plates in the position thereof shown in FIG. 8B.

Obviously, many modifications and variations of the present invention are possible in the light of the above teachings. It should therefore be understood that within the scope of the appended claims, the invention may be practiced otherwise than as specifically described.

What we claim is:

1. An apparatus for storing an elongated flexible element comprising an inner cylindrical frame with an essentially vertical axis, said inner frame having a radius at least equal to the minimum radius of curvature of an elongated flexible element, an outer cylindrical frame placed concentric to said first frame, said inner and outer frames defining therebetween a space being open at the upper part thereof so as to allow for the passage of said elongated flexible element, an annular base structure means, connecting said inner and outer cylindrical frames, for closing the lower part of said space and supporting said elongated flexible element, said space having a dimension in the radial direction between said inner and outer frames greater than the diameter of the cross-section of the elongated element, guide means cooperaling with the resulting structure of inner and outer frames with said annular base means for guiding in rotation about said vertical axis the resulting structure of inner and outer frames with said annular base means, drive means coupled to said guide means for driving in rotation said resulting structure about said vertical axis, and supply means connected to said drive means for supplying power to said drive means, said annular base structure means being formed of a plurality of separate annular sector members, connecting means interconnecting said annular sectors to one another, and means allowing a displacement of said separate sector members with respect to each other in a direction having at least one vertical component, each of said separate sector members carrying therewith a corresponding portion of said inner and outer frames.

2. A storing apparatus according to claim 1, wherein said guide means and said drive means are spaced from said vertical axis of rotation.

3. A storing apparatus according to claim 2, wherein said guide means and said drive means are positioned at a distance from said vertical axis of rotation, said distance being at least equal to the radius of the inner frame.

4. A storing apparatus according to claim 3, wherein said guide means and said drive means are in operative engagement in order to simultaneously support and drive in rotation said annular base structure means, and wherein at least one of said guide means and said drive means is integral with said annular base structure means, and at least the other one of guide means and drive means is stationary with respect to said vertical axis of rotation.

5. A storing apparatus according to claim 4, wherein said guide means includes at least one circular rail, and wherein said drive means include a plurality of wheels in contact with said rail, at least one of said wheels being driven in rotation by a motor, the engagement of said wheels with said rail providing centering of said annular base structure means about said vertical axis of rotation.

6. A storing according to claim 5, further comprising a rotating connecting means for allowing the motor power supply during rotation of said resulting structure, said rotating connecting means being integral with said annular base structure means and essentially coaxial with said vertical axis of rotation.

7. A storing apparatus according to claim 5, wherein said motor is a hydraulic motor.

8. A storing apparatus according to claim 5, wherein said motor is an electric motor.

9. A storing apparatus according to claim 2, wherein said guide means are distinct from said drive means and support solely and permanently the entire weight of said storing apparatus and any contents thereof.

10. A storing apparatus according to claim 9, wherein said drive means comprise a first element consisting of an annular toothed rack being coaxial with said axis of rotation and a second element consisting of at least one toothed pinion being integral in rotation with the drive shaft of at least one motor, said pinion being in operative engagement with said toothed rack so as to drive said annular base structure means in rotation, one of said first and second elements being integral with said annular base structure means, and the other of said first and second elements having a stationary position with respect to said vertical axis of rotation.

11. A storing apparatus according to claim 10, wherein said guide means comprise at least one circular rail having the center at said vertical axis, and a plurality of wheels being in contact with said rail, said wheels being adapted to freely rotate and to center said annular base structure means about said vertical axis, one of said rail and said plurality of wheels being mounted in a stationary position, and the other of said rail and said plurality of wheels being integral with said annular base structure means.

12. A storing apparatus according to claim 11, wherein said drive shaft of said motor integral with said toothed pinion carries one of said wheels.

13. A storing apparatus according to claim 12, wherein said wheel carried by said drive shaft of the motor rotates freely with respect to said shaft.

14. A storing apparatus according to claim 13, wherein said wheel carried by said drive shaft of the motor is mounted integral in rotation with said shaft.

15. A storing apparatus according to claim 9, wherein said guide means comprise a first member including at least one annular bearing belt centered about said vertical axis, a second member including a plurality of wheels adapted to freely rotate, the width of said bearing belt being greater than that of the wheels, and a third centering member for centering said annular base structure means about the vertical axis of rotation, one of said first and second members being stationary and the other of said first and second members being integral with sand annular base structure means such that the weight of said resulting structure is supported.

16. A storing apparatus according to claim 15, wherein said centering member includes an annular conical or tapered roller bearing said annular roller bearing being centered on the vertical axis of rotation, and having, at least one ring which is stationary and at least another ring which is connected in rotation with said annular base structure means, 17. A storing apparatus according to claim 16, wherein said drive means includes an annular toothed crown integral with said annular roller bearing ring which is connected to said annular base structure means, and at least one toothed pinion engaging with said crown, said pinion being integral in rotation with the outlet shaft of a driving motor group having stationary position.

18. A storing apparatus according to claim 1, further comprising a rotating hydraulic connecting means for supplying hydraulic fluid to a flexible drilling column stored in said storing apparatus, said hydraulic connecting means being integral with said annular base structure means and essentially coaxial with said vertical axis of rotation said connecting means supplying hydraulic fluid to one of the ends of said flexible drilling column.

19. A storing apparatus according to claim 1, wherein said connecting means include connecting clamps being secured to the ends of sector members making up said annular base structure means, said connecting clamps including essentially horizontal orifices adapted to be in alignment in an adjacent position of said sector members with respect to one another, and centering rods inserted in said orifices of the connecting clamps, the connecting clamps of at least one sector member being adapted to freely turn or rotate about said rods.

20. A storing apparatus according to claim 1, wherein said connecting means include small rods having ends which are respectively hingedly connected at the ends of the successive sector members forming said annular base structure means, allowing relative displacement of one sector member with respect to a neighboring sector member.

21. A storing apparatus according to claim 20, wherein said small rods are hingedly connected by means of intertwined rings, said intertwined rings being coupled to an additional ring at the ends of each of said small rods, and wherein said annular base structure means further includes plate members for separating respective sector members.

22. A storing apparatus according to claim 21, wherein said additional ring of each of said small rods is rotatable about said small rod.

23. A storing apparatus according to claim 20, wherein said small rods are threadedly connected to respective ends of said sector members.

24. A storing apparatus according to claim 1, wherein said connecting means include connecting clamps secured to the ends of the sector members forming said annular base structure means, said connecting clamps including essentially vertical orifices, and the connecting clamps of one sector member being adapted to be superimposed to those of the next-adjacent sector member so as to align said orifices, and centering rods inserted with a certain play into said orifices such that adjacent sector members are connected, said centering rods having a length sufficient to allow for vertical displacement of one sector member with respect to a neighboring sector member.

25. A storing apparatus according to claim 1, wherein said connecting means include plate members connecting respective ends of said sector members, said plate members being rotatably secured to the ends of said sector members allowing relative displacement of one sector member with respect to an neighboring sector member.

* * * * *